United States Patent [19]

Dutcher

[11] 4,385,687

[45] May 31, 1983

[54] DISPLAY CARTON AND METHOD

[75] Inventor: Dan Dutcher, Woodbury, Minn.

[73] Assignee: Champion International Corporation, Stamford, Conn.

[21] Appl. No.: 309,924

[22] Filed: Oct. 9, 1981

[51] Int. Cl.[3] ..... B65D 5/50

[52] U.S. Cl. ..... 206/45.14; 206/45.31; 206/45.19

[58] Field of Search ..... 206/45.14, 45.19, 45.31; 229/34 HW, 39 B

[56] References Cited

U.S. PATENT DOCUMENTS

| | | | |
|---|---|---|---|
| 3,036,754 | 5/1962 | Kleingers, Jr. | 206/45.14 |
| 3,493,103 | 2/1970 | Cote | 206/45.31 |
| 3,669,253 | 1/1972 | Hanko | 206/45.14 |
| 3,812,957 | 5/1974 | Forbes, Jr. | 206/45.14 |
| 4,159,765 | 7/1979 | Roccaforte | 206/45.31 |

*Primary Examiner*—William T. Dixson, Jr.

*Attorney, Agent, or Firm*—Evelyn M. Sommer; John H. Mulholland

[57] ABSTRACT

A shadow display carton and blank for same with a slanted side shadow panel and a lower vertical panel to frame the article to be displayed and a die cut folded portion to support, cushion and restrain the article away from the bottom of the carton. The bottom of the carton is designed to permit end loading on conventional automatic seal end equipment.

12 Claims, 13 Drawing Figures

FIG.10
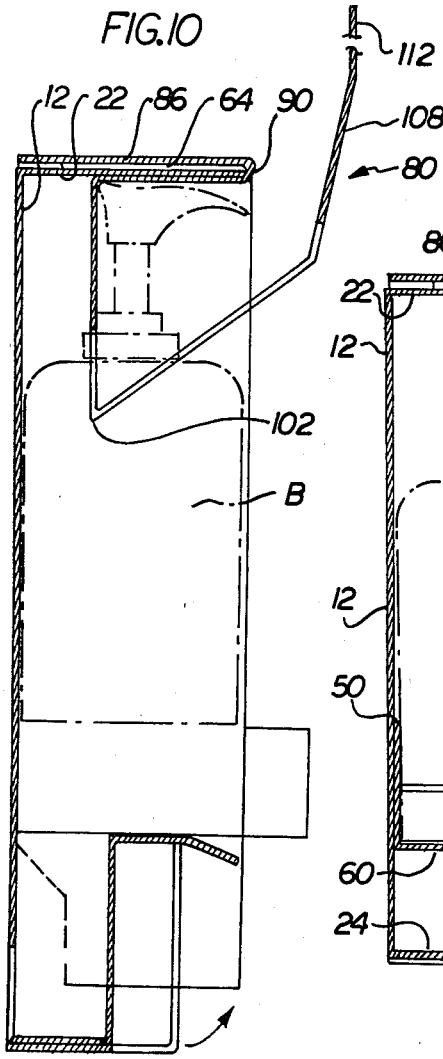
FIG.11
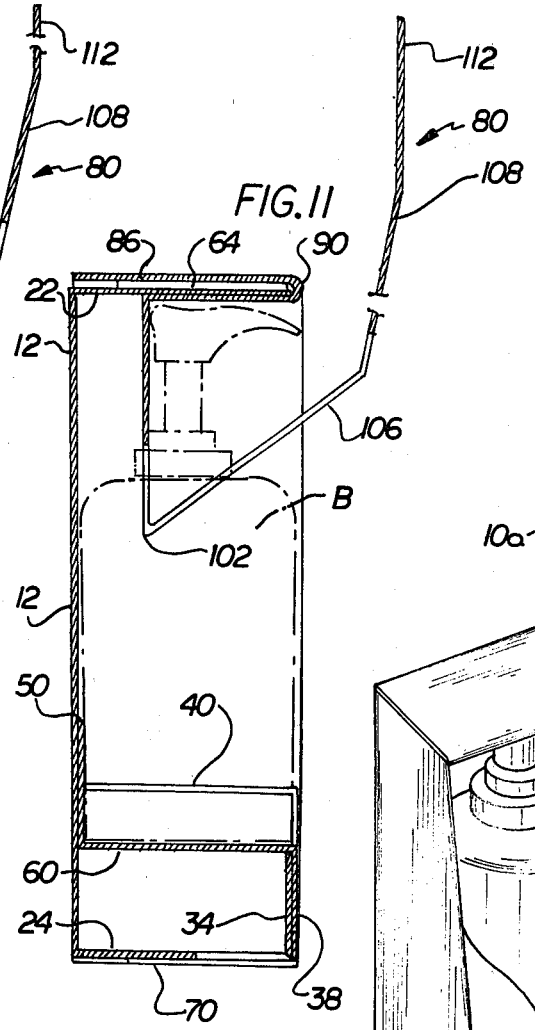
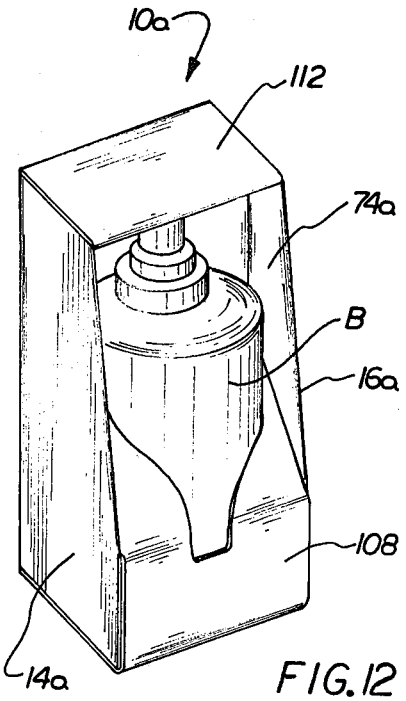
FIG.12
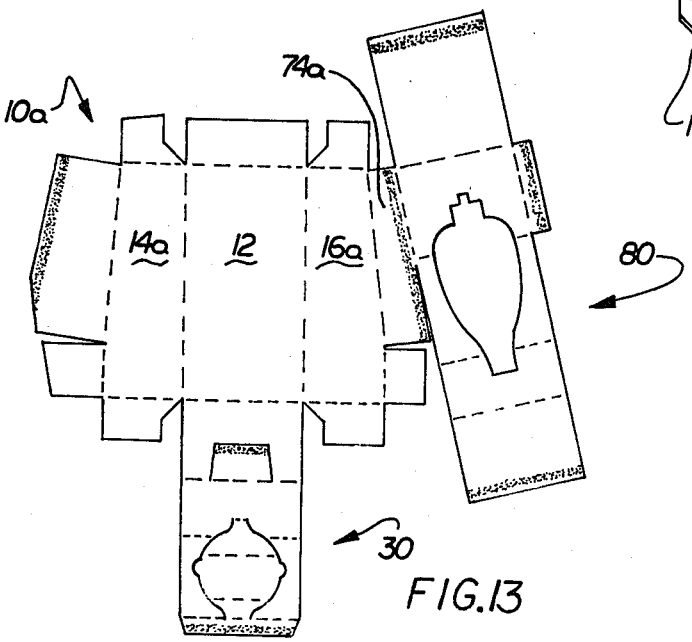
FIG.13

DISPLAY CARTON AND METHOD

BACKGROUND AND SUMMARY OF THE INVENTION

This disclosure relates to a shadow display carton and blank for same with a lower vertical panel and slanted side panel portions to frame substantially the full front of the article to be displayed and a die cut folded portion to support, cushion and restrain the article away from the carton bottom.

U.S. Pat. No. 4,159,765, to Harry I. Roccaforte, assigned to the same assignee as the present application, discloses a display carton for small objects which restrains and protects an article packaged therein to reduce damage during shipment and storage and which can be loaded on currently available cartoning equipment. The front of the packaged article, however, is not substantially fully displayed.

It is an object of the instant invention to provide a carton and method of automatically packaging. The novel carton cushions and restrains the articles away from the carton bottom, can be erected, loaded and sealed on currently available cartoning equipment and provides a substantially full front display of the packaged article framed by slanted side shadow panel portions and a lower vertical panel.

BRIEF DESCRIPTION OF THE DRAWINGS

Further objects and advantages will become apparent from the following description and claims and from the accompanying drawings, wherein:

FIG. 10 is a side elevational view of the partially erected and closed carton with the article to be packaged shown in phantom loaded in the package;

FIG. 11 is a side elevational view similar to FIG. 10 just prior to final carton closing and sealing;

FIG. 12 is a perspective view similar to FIG. 1 an alternative embodiment;

FIG. 13 is a plan view similar to FIG. 5 of a blank adapted to be erected into the carton shown in FIG. 13.

DETAILED DESCRIPTION OF THE ILLUSTRATED EMBODIMENTS

Figure 1:
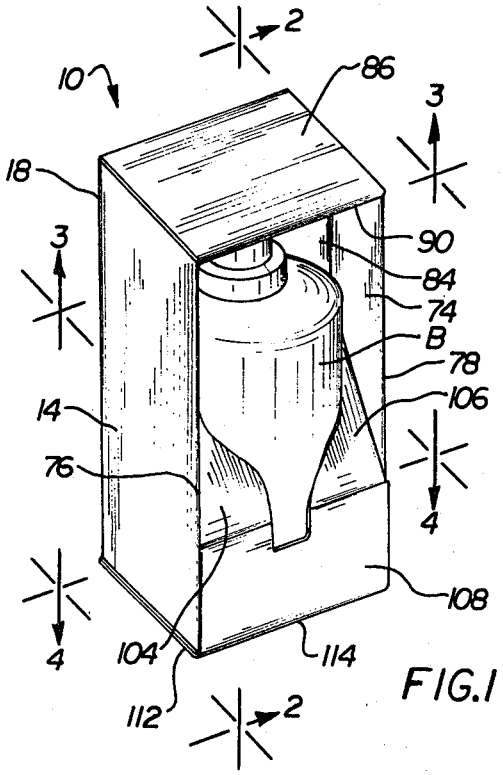
FIG. 1 is a perspective view of an assembled carton containing a packaged article and constructed according to the principals of the invention.
Figure 2:
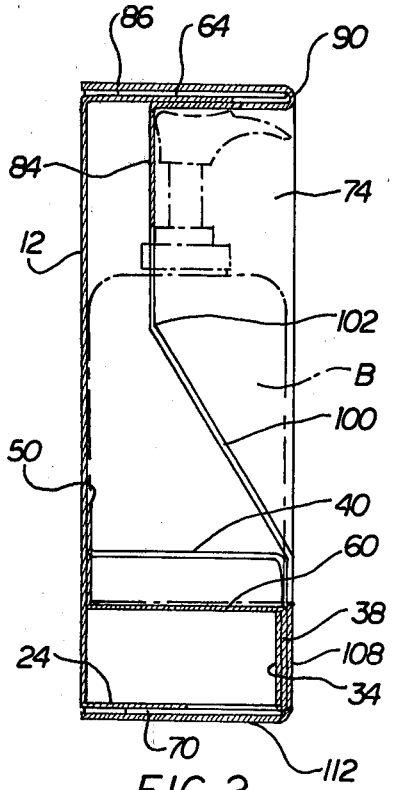
FIG. 2 is a cross-sectional elevational view of the carton taken along line 2—2 of FIG. 1.

The shadow display carton of FIGS. 1 to 11 is generally designated by the numeral 10.

The shadow display carton 10 is designed to frame the article to be displayed and to cushion and restrain it away from the bottom of the carton thereby protecting it during shipping.

The carton 10 includes a vertical rectangular back panel 12 and side panels 14 and 16 hingedly attached thereto along vertical edges of the back panel 12 defined by fold lines 18 and 20. The vertical rectangular back panel 12 has a top end flap 22 and a bottom end flap 24 hingedly attached thereto by fold lines 26 and 28, respectively.

The bottom end flap 24 has a bottom cushioning means generally designated by the numeral 30 hingedly attached thereto along horizontal fold line 32. A reinforcement panel 34 is cut in the bottom end flap 24 along a line 36 whose ends terminate substantially at horizontal fold line 32. The cushioning means 30 further includes an inner vertical panel 38 hingedly attached to said bottom end flap 24 by fold line 32.

A pair of horizontal panels 40 and 42 are hingedly attached to inner vertical panel 38 by means of a fold line 44. The horizontal panels 40 and 42 are defined by a pair of slots 46 and 48 aligned transverse to the bottom edge 28 of the back panel 12. The slots 46 and 48 extend into inner vertical panel 38 on one end thereof and extend to a vertical glue flap 50 hingedly attached to the horizontal panels 40 and 42 along fold line 52. The glue flap 50 is secured to the inside of the back panel 12. The cushioning means 30 further includes a first horizontal fold line 54 which extends between the ends of the slots 46 and 48 in the inner vertical panel 38. A second horizontal fold line 56 extends between the slots 46 and 48, intermediate their ends, to define a horizontal cushioning support panel 60 spaced from the bottom end flap 24 of the carton by the height of the reinforcement panel 34.

The side panels 14 and 16 have closure flaps 62, 64, 68 and 70, respectively, hingedly attached at opposite ends thereof. Side flaps 72 and 74 are hingedly attached along side edges 76 and 78, respectively, opposite the vertical edges of side panels 14 and 16 defined by fold lines 18 and 20. The side flap 74 has a slanted shadow panel means generally designated by the numeral 80 hingedly attached thereto along fold line 82.

The slanted shadow panel means 80 includes an upper vertical portion 84 having one edge including the fold line 82. A horizontal panel portion 86 is hingedly connected to the vertical portion 84 of the shadow panel means 80 by means of a fold line 88 and includes a front edge fold line 90 by which it is folded back upon itself around the top end flap 22 and side panel end flaps 62 and 64. The vertical panel portion 84 has a fold line 92 on the edge opposite and parallel to fold line 82 by which a glue flap 94 for secured engagement with side panel side flap 72. A slanted shadow panel structure or portion 100 is hingedly attached to the lower vertical portion 84 by means of a fold line 102. The panel 100 is divided into two slanted panel portions 104 and 106 by means of a cut line 109 which defines an article receiving opening in the slanted shadow panel means 30. On the lower end of the slanted shadow portion 100 a lower outer vertical panel 108 is hingedly attached to the slanted panel portion 100 by means of a fold line 110.

The cut line 109 separating the slanted panel portion 100 into panel portions 104 and 106 defines recesses in the upper vertical panel portion 84 and the lower outer vertical panel portion 108.

The bottom end of the carton and the end cushioning means 30 is enclosed by means of a bottom panel portion 112 hingedly attached to the lower edge 114 of lower vertical panel 108 and secured by means of glue area 116.

Figure 5:
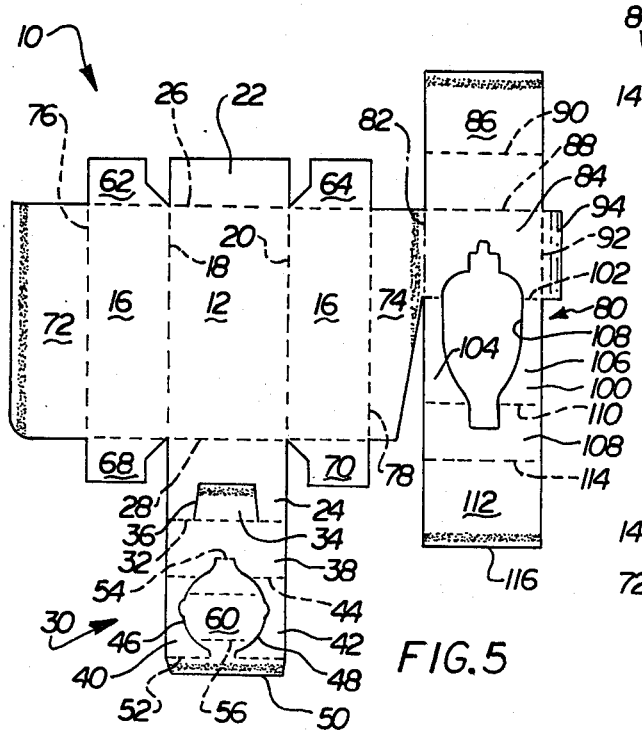
FIG. 5 is a plan view of a blank adapted to be erected into the carton shown in FIGS. 1-3.
Figure 3:
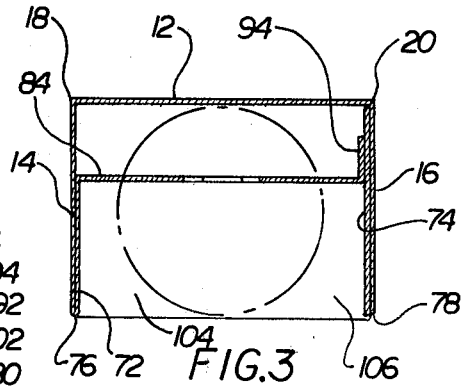
FIG. 3 is a cross-sectional view taken along line 3—3 of FIG. 1.
Figure 4:
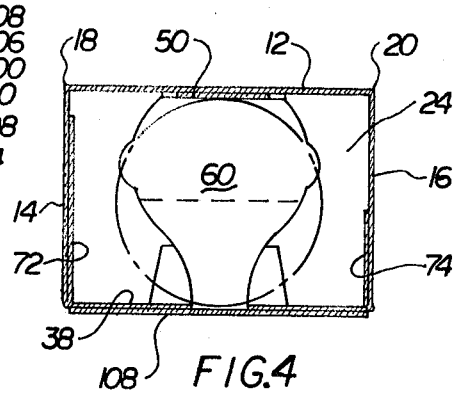
FIG. 4 is a cross-sectional view taken along the line 4—4 of FIG. 1.
Figure 6:
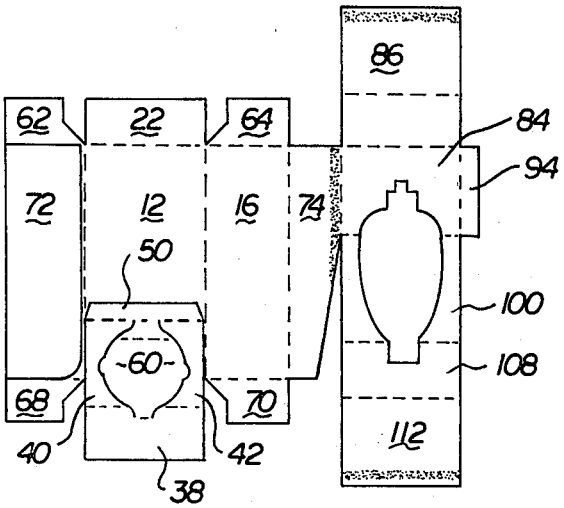
FIG. 6 is a plan view of the blank of FIG. 5 partially folded and glued as would typically be performed on automatic equipment.
Figure 7:
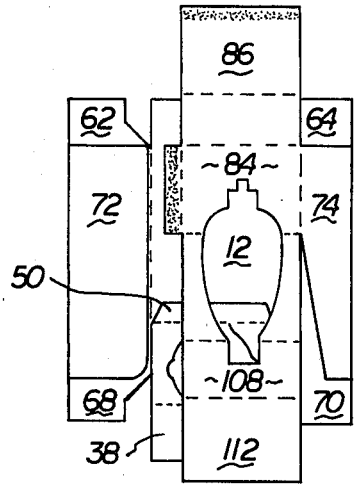
FIG. 7 is a plan view of the blank of FIG. 6 illustrating the next folding step.
Figure 8:
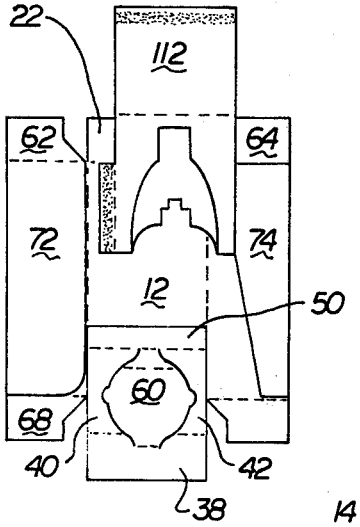
FIG. 8 is a plan view of the blank with the slanted shadow panel means folded back to expose the chsioning means.
Figure 9:
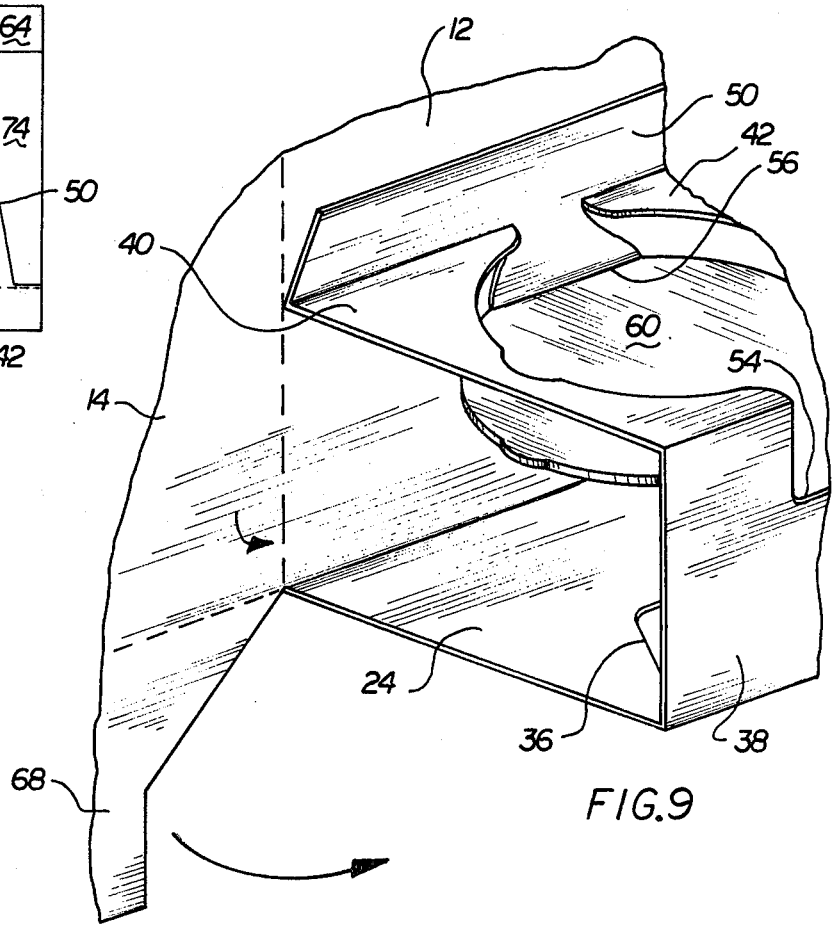
FIG. 9 is a fragmentary perspective view illustrating the cushioning means of the partially erected carton of FIG. 1.

FIGS. 6 through 8 show progressive folding of the blank of FIG. 5. FIG. 9 shows in perspective the detail of the cushioning means 30.

In packaging an article such as the illustrated soap dispenser bottle B, the bottle B is placed in position as shown in FIG. 10 with the slanted shadow panel means 80 folded back out of the way over the already closed top end of the carton. The cushioning means 30 is then erected and swung upwardly to support the bottom of the bottle as shown in FIG. 11. The slanted shadow panel means 80 is then brought downwardly about fold line 102 to complete the carton as shown in FIG. 1. This construction and loading process in the sequence given can be performed on conventional automatic seal end equipment.

Accordingly, a carton which cushions and restrains the article away from the carton bottom can be erected, loaded and sealed on currently available cartoning equipment to provide a substantially full front display of the packaged article framed by slanted side shadow panel portions and a lower vertical panel.

FIGS. 12 and 13 show a slightly different embodiment of the shadow display blank and carton of the invention. The major differences of this embodiment of the invention is that side panels 14*a* and 16*a* are not rectangular and, therefore, provide a carton in which the carton sides are narrower at their upper extremities than at their lower extremities.

What is claimed is:

1. A shadow display carton which cushions and restrains the packaged article away from the carton bottom and provides a substantially full front display of the article framed by a slanted side shadow panel and a lower vertical panel comprising:

a vertical rectangular back panel;

side panels hingedly attached along vertical edges of said back panel;

top and bottom end flaps hingedly attached to said rectangular back panel, one at the horizontal top edge thereof and one at the horizontal bottom edge thereof;

said bottom end flap having a bottom cushioning means hingedly attached thereto along a horizontal fold line;

said side panels having closure flaps hingedly attached at opposite ends thereof and side flaps hingedly attached along side edges opposite the vertical edges attached to said back panel;

one of said side flaps having a slanted shadow panel means hingedly attached thereto.

2. The shadow display carton of claim 1 in which the slanted shadow panel means includes a slanted panel structure defining an opening through which the article to be displayed extends upwardly.

3. The shadow display carton of claim 1 which the slanted shadow panel means includes a vertical portion which has an edge hingedly attached to said side flap.

4. The shadow display carton of claim 1 in which the slanted shadow panel means has a horizontal panel portion which forms the outer top end of the carton.

5. The shadow display carton of claim 1 in which the slanted shadow panel means has a horizontal panel portion which forms the outer bottom end of the carton.

6. The shadow display carton of claim 1 in which the slanted shadow panel means has an outer vertical panel means hingedly attached to the lower edge of the slanted panel portion.

7. The shadow display carton of claim 1 in which the side flaps are narrower at their upper extremities than at their lower extremities.

8. The shadow display carton of claim 1 in which said bottom end flap has a reinforcement panel cut therein along a line whose ends terminate substantially at the horizontal fold line hingedly attaching said bottom cushioning means to said bottom end flap.

9. The shadow display carton of claim 1 in which said cushioning means includes an inner vertical panel hingedly attached to said bottom end flap along the horizontal fold line attaching said bottom cushioning means to said bottom end flap.

10. The shadow display carton of claim 9 in which said cushioning means further includes a pair of horizontal panels hingedly attached to said inner vertical panel along a horizontal fold line;

said horizontal panels being defined by a pair of slots aligned transverse to said bottom edge of said back panel and extending into said inner vertical panel on one end thereof and extending to a vertical glue flap hingedly attached to said pair of horizontal panels and secured to the inside of said back panel;

said cushioning means further including a first horizontal fold line between the ends of said slots in said inner vertical panel and a second horizontal fold line between said slots intermediate the ends of said slots to define a cushioning support panel extending from said vertical rectangular back panel to said inner vertical front panel.

11. A blank for a shadow display carton which cushions and restrains the packaged article away from the carton bottom and provides a substantially full front display of the article framed by a slanted side shadow panel and a lower vertical panel comprising:

a vertical rectangular back panel;

side panels hingedly attached along vertical edges of said back panel;

top and bottom end flaps hingedly attached to said rectangular back panel, one at the horizontal top edge thereof and one at the horizontal bottom edge thereof;

said bottom end flap having a bottom cushioning means hingedly attached thereto along a horizontal fold line and a reinforcement panel cut therein along a score line whose end terminates substantially at said horizontal fold line;

said cushioning means including an inner vertical panel hingedly attached to said bottom end flap along said horizontal fold line;

said cushioning means further including a pair of horizontal panels hingedly attached to said inner vertical panel along a horizontal fold line;

said horizontal panels being defined by a pair of slots aligned transverse to said bottom edge of said back panel and into said inner vertical panel on one end thereof and extending to a vertical glue flap hingedly attached to said pair of horizontal panels;

said cushioning means further including a first horizontal fold line between the ends of said slots in said vertical panel and a second horizontal fold line between said slots intermediate the ends of said slots;

said side panels having closure flaps hingedly attached at opposite ends thereof and side flaps hingedly attached along side edges opposite the vertical edges attached to said back panel;

one of said side flaps having a slanted shadow panel means hingedly attached thereto which includes further structure defining an opening therein for receiving the packaged article.

12. A method of automatically packaging an article which comprises the steps of:

providing a folded blank which includes a back panel, side panels, a top closure structure, a slanted shadow panel having a central opening and attached top and bottom horizontal panels, and a bottom cushioning means hingedly attached to the bottom edge of said back panel;

closing said carton top end and erecting said side panels;

attached said top horizontal panel of said slanted shadow panel to the closed top carton end and folding said shadow panel upwardly and back upon itself about a line intermediate its ends and intersecting said opening;

loading a fragile article to be packaged through the carton bottom end and upwardly into said central opening;

hingedly moving said cushioning means into closed position to close said carton bottom end and support said fragile article; and, attaching said bottom horizontal panel to said cushioning means to complete said package.

* * * * *